US008706328B1

(12) United States Patent
Nishinaga et al.

(10) Patent No.: US 8,706,328 B1
(45) Date of Patent: Apr. 22, 2014

(54) VEHICLE-BASED SWITCH MECHANISMS IN FIXED GUIDEWAY TRANSPORTATION SYSTEMS AND METHODS FOR CONTROLLING SAME

(75) Inventors: Eugene Iwao Nishinaga, San Rafael, CA (US); Kevin Kohei Nishinaga, San Rafael, CA (US); Mark Lee, San Rafael, CA (US)

(73) Assignee: Cybertrain International, Inc., Richmond, CA (US)

( * ) Notice: Subject to any disclaimer, the term of this patent is extended or adjusted under 35 U.S.C. 154(b) by 183 days.

(21) Appl. No.: 13/323,759

(22) Filed: Dec. 12, 2011

Related U.S. Application Data

(63) Continuation-in-part of application No. 13/218,422, filed on Aug. 25, 2011, and a continuation-in-part of application No. 13/218,423, filed on Aug. 25, 2001, and a continuation-in-part of application No. 13/218,429, filed on Aug. 25, 2011, and a continuation-in-part of application No. 13/218,434, filed on Aug. 25, 2011, now Pat. No. 8,554,397.

(60) Provisional application No. 61/459,247, filed on Dec. 10, 2010.

(51) Int. Cl.
*B61F 13/00* (2006.01)
*E01B 25/06* (2006.01)

(52) U.S. Cl.
USPC ..... 701/19; 701/20; 104/130.07; 246/219

(58) Field of Classification Search
USPC ..... 701/19, 117, 20; 104/130.07; 246/219
See application file for complete search history.

(56) References Cited

U.S. PATENT DOCUMENTS 3,783,793 A * 1/1974 Perrott et al. ..... 104/130.01
3,811,383 A * 5/1974 Butzow ..... 104/130.01
6,095,054 A * 8/2000 Kawano et al. ..... 104/139
2001/0001843 A1 * 5/2001 Alofs et al. ..... 701/24
2008/0015745 A1 1/2008 Gaegauf et al.
2008/0154452 A1 6/2008 Kapp et al.
2008/0167767 A1 7/2008 Brooks et al.
2010/0114407 A1 5/2010 Klooster et al.
2010/0318247 A1 12/2010 Kumar
2010/0319565 A1 12/2010 Mobasher

OTHER PUBLICATIONS

Nishinaga, et al., "A Vehicle Collision Avoidance System Using Time Multiplexed Hexadecimal FSK", Boeing Aerospace Company, IEEE/Vehicular Technology Conference, vol. 33, 1983, pp. 171-182.
Burt, H.G.P., et al., "Microprocessor Control of Wheel Slip," IEEE, 1985, pp. 19-28.

* cited by examiner

*Primary Examiner* — Tan Q Nguyen
(74) *Attorney, Agent, or Firm* — Pillsbury Winthrop Shaw Pittman LLP

(57) ABSTRACT

The present invention relates generally to ground transportation systems, and more particularly to a fixed guideway transportation system that achieves a superior ratio of benefits per cost, is lower in net present cost and thus more easily justified for lower density corridors, and can provide passenger carrying capacities appropriate for higher density corridors serviced by mass rapid transit systems today. According to certain aspects, the present invention increases traffic densities by removing fixed obstacles such as track switches. In embodiments, this is achieved by providing vehicle-based switching mechanisms that interoperate with corresponding track structures to allow vehicles to switch tracks without any moving components on the track itself. According to further aspects, the invention provides a method of operating vehicle-based switching mechanisms that comply with safety requirements.

12 Claims, 5 Drawing Sheets

VEHICLE-BASED SWITCH MECHANISMS IN FIXED GUIDEWAY TRANSPORTATION SYSTEMS AND METHODS FOR CONTROLLING SAME

CROSS-REFERENCE TO RELATED APPLICATIONS

The present application is a continuation-in-part of U.S. patent application Ser. No. 13/218,422, filed Aug. 25, 2011. The present application is also a continuation-in-part of U.S. patent application Ser. No. 13/218,423, filed Aug. 25, 2011. The present application is also a continuation-in-part of U.S. patent application Ser. No. 13/218,429, filed Aug. 25, 2011. The present application is also a continuation-in-part of U.S. patent application. Ser. No. 13/218,434, filed Aug. 25, 2011. The present application also claims priority to U.S. Provisional Application No. 61/459,247, filed Dec. 10, 2010. The contents of all such applications are incorporated herein by reference in their entirety.

FIELD OF THE INVENTION

The present invention relates to fixed guideway transportation systems, and more particularly to vehicle-based switching mechanisms and operating methods thereof for use in such systems.

BACKGROUND OF THE INVENTION

Modern mass rapid transit rail systems are very effective carriers of people. They are generally grade separated systems to enable vehicles to operate unaffected by automobile traffic, and thereby are able to achieve traffic densities otherwise unachievable. They are, however, very expensive. A typical, but conservative order of magnitude system capital cost for a system is approximately $100 million per bi-directional track mile of system, making it difficult for communities and cities to justify and/or afford the cost of new construction. This limitation has the effect of constraining the reach of these systems, and thus limiting the convenience to the users who can only ride the systems to the few locations to which guideway has been constructed. This results in a classic case of Catch 22. The high cost of systems requires a high ridership to justify the cost. However, high guideway costs limit construction and thus the reach of fixed guideway systems. This limits convenience to the riders, making it difficult to achieve the high ridership needed to justify the high cost.

Conventional mass rapid transit rail technology attempts to improve the ratio of benefits per unit cost by focusing on serving the commuting public. This means building systems to achieve very high passenger capacities to major employment centers. An example conventional system is shown in FIG. 1. As shown, conventional systems 110 achieve high capacities by building heavy infrastructure and operating long heavy trains 112 that typically carry a large number of riders to the few large employment centers 114, 116 that they can most effectively service, while bypassing smaller towns or communities 118, 120. This, however, requires very costly guideway 122 and station structures 124, 126, which limits the system's reach and thus convenience for the users, especially for those who want to travel to the generally more widely distributed retail, residential, or recreational destinations.

With guideway 122 and station structures 124, 126 that must be built to handle long heavy trains 112 to support demand during commute hours, the result is an expensive but marginally justifiable solution for commute hour travel which is far too expensive to justify for other periods of the day and other destinations.

Other existing transportation systems that aim to be less expensive to build and operate include automated people mover (APM) systems, such as those operating in many modern airports and some cities. These systems are low speed/low capacity systems that operate driverless vehicles at speeds in the range of 25 to 30 mph and achieve line capacities in the range of 2,000 to 3,000 passengers per hour per direction. Given the limited speed and capacity of these systems, even with the somewhat lower cost of construction due to the use of smaller vehicles, the benefit per cost is still poor. Furthermore, with the lower speeds and line capacities, these systems are limited in utility to local service routes.

Another type of transportation system that has been discussed is called "personal rapid transit" (PRT). PRT's differ from the more common APM systems in that these systems are built with offline stations which allow higher traffic densities to be achieved. Typically these systems operate driverless cars that seat four to six people and can provide service on a personal demand-driven basis. However, with the very small cars, high speeds are difficult to achieve and line capacities are severely restricted. There is one PRT that is operating at West Virginia University, the Morgantown PRT, which is an 8.2 mile long system having cars that seat 20 people. With a claim of 15 second headways, a line capacity of 4,800 passengers per hour per direction can be achieved. With rubber-tired vehicles, however, the top speed of the system is 30 mph thus limiting its applicability to low speed local service lines.

Co-pending application Ser. No. 13/218,422, the contents of which are incorporated by reference in their entirety, dramatically advanced the state of the art by providing a fixed guideway transportation system that can overcome many of the above and other challenges of the prior art. For example, the system of the co-pending application includes driverless vehicles carrying 10 to 30 persons designed for optimal ratio of benefits per cost. However, certain challenges remain.

For example, in order to cost effectively build and operate a system that operates smaller vehicles such as those contemplated by the co-pending application, yet achieves line capacities that justify the cost of constructing track infrastructures, the density of traffic that can be achieved needs to be sufficiently high. That means that safe operating headways must be made smaller than those achievable with conventional control systems that represent today's state of the art. Furthermore, these safe operating headways should be achieved at mass rapid transit speeds (at least 60 mph). This cannot be achieved with current systems.

Safe operation further requires that vehicles must always be able to stop before arriving at obstacles on the track. With all track geometries (i.e. grade, track curvature) being equal, the greatest restriction will occur where there are fixed obstacles (i.e. zero speed obstacles) in the path of the vehicle. Therefore, in order to achieve high traffic densities, it is desirable to eliminate the existence of fixed location obstacles on the track, such as switch points between tracks.

Relatedly, since a collision between two vehicles is a life-threatening event, control functions that prevent collisions are critical to safety. In the rail industry, control that is critical to safety must be designed and implemented to a standard commonly referred to as "vital." In recent years achieving vital status has required an analytical demonstration of a Mean Time Between Unsafe Event or Hazard (MTBH) of $10^9$ hours or greater. Accordingly, any methodology aimed at increasing traffic density by removing fixed obstacles such as track switches should include collision protection satisfying this standard.

SUMMARY OF THE INVENTION

The present invention relates generally to ground transportation systems, and more particularly to a fixed guideway transportation system that achieves a superior ratio of benefits per cost, is lower in net present cost and thus more easily justified for lower density corridors, and can provide passenger carrying capacities appropriate for higher density corridors serviced by mass rapid transit systems today. According to certain aspects, the present invention increases traffic densities by removing fixed obstacles such as track switches. In embodiments, this is achieved by providing vehicle-based switching mechanisms that interoperate with corresponding track structures to allow vehicles to switch tracks without any moving components on the track itself. According to further aspects, the invention provides a method of operating vehicle-based switching mechanisms that comply with safety requirements.

In furtherance of these and other aspects, an apparatus for causing a vehicle to switch tracks in a fixed guideway transportation system according to embodiments of the invention includes a switch mechanism mounted on the vehicle that interoperates with corresponding fixed track structures to allow the vehicle to switch tracks without any moving components on the tracks.

In additional furtherance of these and other aspects, a method for causing a vehicle to switch tracks in a fixed guideway transportation system according to embodiments of the invention includes mounting a switch mechanism on the vehicle; and causing the switch mechanism to interoperate with corresponding fixed track structures to allow the vehicle to switch tracks without any moving components on the tracks.

In additional furtherance of these and other aspects, a fixed guideway transportation system according to embodiments of the invention includes a switch point between a first set of rails and a second set of rails; fixed track structures at the switch point; and a switch mechanism mounted on a vehicle that interoperates with certain of the fixed track structures to allow the vehicle to switch between the first set of rails and second set of rails without any moving components on the rails.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF THE PREFERRED EMBODIMENTS

Figure 1:
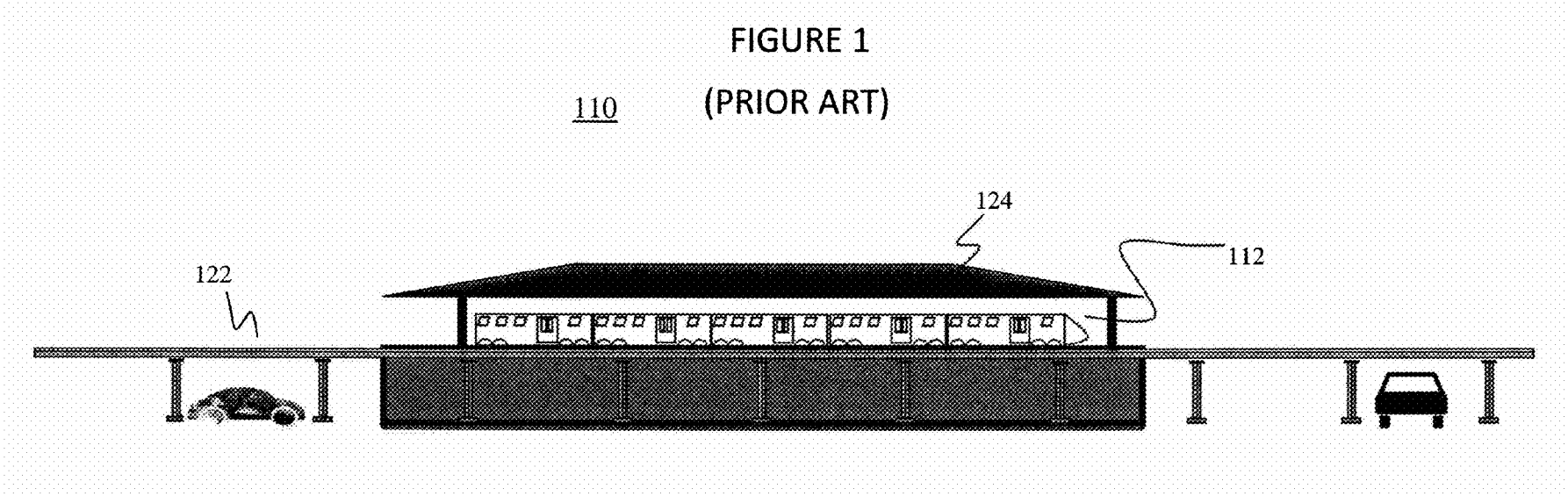
FIGURE 1 (PRIOR ART)
FIG. 1 illustrates a conventional mass transit system.

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements. Moreover, where certain elements of the present invention can be partially or fully implemented using known components, only those portions of such known components that are necessary for an understanding of the present invention will be described, and detailed descriptions of other portions of such known components will be omitted so as not to obscure the invention. Embodiments described as being implemented in software should not be limited thereto, but can include embodiments implemented in hardware, or combinations of software and hardware, and vice-versa, as will be apparent to those skilled in the art, unless otherwise specified herein. In the present specification, an embodiment showing a singular component should not be considered limiting; rather, the invention is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

According to certain aspects, the invention of the co-pending application enables the construction of rail lines that: 1. achieve a superior amount of benefits per cost; 2. are lower in cost and thus more easily justified for lower density corridors; and 3. can provide passenger carrying capacities appropriate for higher density corridors serviced by mass rapid transit systems today.

In certain embodiments, these objectives are met by utilizing smaller vehicles that can operate on a less expensive infrastructure. Using certain methods according to the co-pending application, the costs of fixed guideway mass rapid transit systems are reduced, allowing more destinations to be accessed. Also, with certain methods according to the co-pending application, the same structures appropriate for low ridership corridors and/or service hours can be used to achieve passenger carrying capacities needed for the high capacity corridors served today by modern mass rapid transit systems.

According to further aspects, the invention of the co-pending application improves the amount of benefits per cost of rail transit by reducing the cost to levels more justifiable for low density corridors. To be meaningful, certain methods according to the co-pending application achieve improved benefits per cost in a holistic manner, in other words, by reducing the net cost of ownership which includes not only the cost of equipment but also the net cost of operating and maintaining the system.

Although the principles of the inventions of the co-pending application and the present application will be explained in connection with applications to conventional diesel and/or electrified rail systems, the invention is not limited to these types of systems. For example, the principles of the invention can be extended to conventional and other vehicle technologies that do not rely on steel wheels rolling on steel rail.

According to certain aspects, the present inventors recognize that increasing traffic density, such as that contemplated in the system according to the co-pending application, cannot be achieved with conventional control methodologies and track switching systems. For example, the present inventors recognize that the traffic density that can be achieved on any given line of rail service is predominantly determined by the rate at which vehicles can be made to pass the most headway restricted point on the line. Since safe operation requires that vehicles must always be able to stop before arriving at obstacles on the track, with all track geometries (i.e. grade, track curvature) being equal, the greatest restriction will occur where there are fixed obstacles (i.e. zero speed obstacles) in the path of the vehicle. Therefore, in order to achieve high traffic densities, it is desirable to eliminate the existence of fixed location obstacles on the track.

There are generally two types of zero speed obstacles that can exist in system. First are the obstacles that are physically fixed to the infrastructure and thus are always present. The second are vehicles on the track that must be treated as zero speed obstacles when they are stopped but not necessarily so when they are moving.

The present invention is directed to removing certain of the first type of zero speed obstacles. Example methods and systems for dealing with moving vehicles on the tracks as obstacles are described in co-pending application Ser No. 13/218,422.

In conventional systems there are three different types of fixed location obstacles. First, vehicles stopped at station platforms are stationary obstacles to other vehicles approaching the platform. This means that vehicles at platforms, even if there were no other obstacles in the system, become a capacity limiting feature on the line since the line capacity is limited by the worst location on the line.

Second, on systems that use control technology that are based on fixed block technology, by the very fact that detection blocks are fixed in space, requires that the leading edge of the occupied block in front of a trailing vehicle must be treated as fixed obstacle locations for the following vehicle.

Third, on conventional rail, the points of switch are fixed obstacles on the track. This is because while a switch is moving and is in an intermediate position, a vehicle arriving at the switch before it has locked itself in the new position can derail.

The need to consider each of the three fixed location obstacles described above becomes what limits the capacity of a rail service line. Thus, until a means is implemented to eliminate these constraints, there is little advantage to changing the control rules to account for moving vehicle obstacles.

Example methods and systems for dealing with the first two of the above three fixed location obstacles described above are described in more detail in co-pending application Ser. Nos. 13/218,423 and 13/218,429, the contents of which are incorporated by reference herein. The present invention is more directly related to a method and system of eliminating track switch points as locations of fixed obstacles, which preferably is practiced together with the methods and systems described in the co-pending applications.

Conventional rail enforces movement through diverging tracks using movable switches in the rail. With this approach, the rail at the point where the track diverges must be moved using mechanical devices that effectuate the move. Since the rail is typically a very heavy piece of steel, this movement takes time (a few seconds). Furthermore, since it is unsafe to move a train over the point of switch if the movable rail is not locked in place, time must be allowed for the switch to lock, and then for it to report to the station that the locking mechanism has been engaged, before the control logic can allow movement of a vehicle over the switch. As a result, after one vehicle passes a point of switch, if the next vehicle is to take a different route over the switch, an immovable obstacle must be assumed to exist at the switch point until the first vehicle passes and the switch has moved and locked in the new position.

According to certain aspects, to eliminate a switch point obstacle, the invention selects and enforces the route through the switch point without the movement of the rail in the guideway. In other words, the path that the vehicle will take will be enforced by equipment on board the vehicle, rather than on the rail. This allows the direction of travel to be selected well before the vehicle arrives at the point of switch, thus allowing the control logic to ignore the point of track divergence as an obstacle.

In order for a system to safely overcome the restriction imposed by switch point obstacles, there are two methods that are preferably implemented in embodiments of the invention. The first is a method for mechanically selecting and enforcing the direction of travel of a vehicle through a point of switch. The second is a method for integrating the switch mechanism and the vehicle control logic in a way that ensures safe operation at all times.

Figure 2:
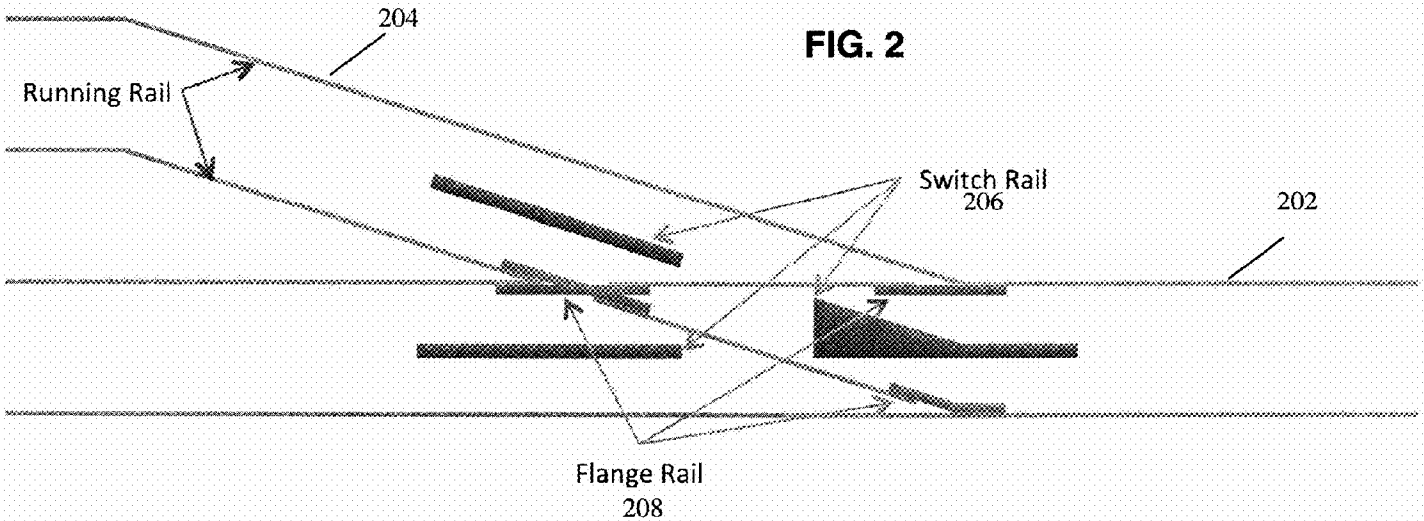
FIG. 2 illustrates an example of track structures used with vehicle-borne switch mechanisms according to embodiments of the invention.

A mechanism that can enforce the selected vehicle movement through a switch is one aspect of the invention. FIG. 2 illustrates, in concept, how a diverging rail is designed according to embodiments of the invention.

As shown in FIG. 2, to facilitate the switching of a vehicle from track 202 to track 204 (e.g. when a vehicle is moving from right to left on rail 202 in the orientation of FIG. 2), the intersection between rail 202 and 204 includes several additional track structures. In this embodiment, the structures include switch rails 206 and flange rails 208. As can be seen, switch rails 206 are structures that are generally in the center of track 202 and/or track 204. As will be described in more detail below, vehicle-borne switch mechanisms engage with appropriate ones of rails 206 when traversing a track intersection. Meanwhile, flange rails 208 are designed to allow movement of a vehicle through the intersection when a vehicle is changing track. For example, flange rails 208 permit the wheels of a vehicle to roll freely and/or disengage with the rails while the vehicle is changing track.

Figure 3B:
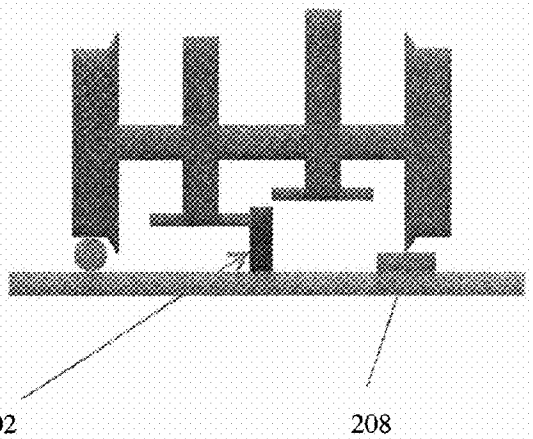
FIGS. 3A and 3B illustrate operational aspects of example vehicle-borne switch mechanisms with track structures such as those shown in FIG. 2.
Figure 3A:
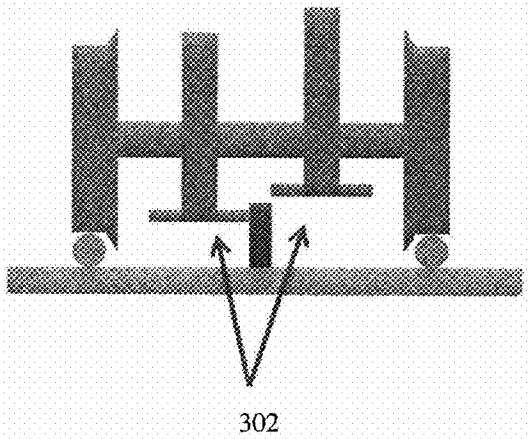

FIGS. 3A and 3B illustrate how a mechanism on the vehicle will operate and interact with the rail shown in FIG. 2 to cause the vehicle to take the selected route through the switch according to embodiments of the invention.

As shown in FIG. 3A, vehicle-borne switches according to embodiments of the invention include switch wheels 302 which are controllably driven to engage or disengage from switch rails 206, thereby controllably causing the vehicle to switch rails. Meanwhile, as shown in FIG. 3B, flange rails 208 permit certain wheels of the vehicle to roll freely while the vehicle is engaged with switch rails 206.

In embodiments, switch rails 206 are cement or other substantially rigid structures that are built into and/or secured to the fixed guideway for tracks 202 and 204 so as to remain fixed in place while forcing a vehicle to turn along tracks 202/204. As can be generally seen in FIG. 2, they can be shaped so as to cause the vehicle to travel onto another track while a switch wheel 302 on the vehicle is engaged therewith. As should be apparent, their height is adjusted so as to permit engagement with switch wheels 302 while otherwise not interfering or blocking the motion of vehicles on tracks 202 and 204.

In embodiments, flange rails 208 are steel or other metal structures that are substantially the same composition as the travel rails of tracks 202 and 204. However, as can be seen generally in FIGS. 3A and 3B, they are flattened or otherwise have reduced height so as to support a wheel on its flange (the portion of the wheel that has the largest diameter) when a wheel is engaged with a flange rail. Vehicle-based switching systems require that gaps exist in the running rail at switch points. In some implementations, these gaps are large enough that the vehicle will not travel smoothly through a switch. Flange rails support the vehicle during such gaps and provide smooth travel through the switch. It should be noted that because the flange of the wheel has a larger diameter than the typical running surface of the wheel, the vehicle axle will tend to turn towards the direction that the vehicle is already turning, further enforcing safe movement of the vehicle through the switch.

Figures 4A, 4B:
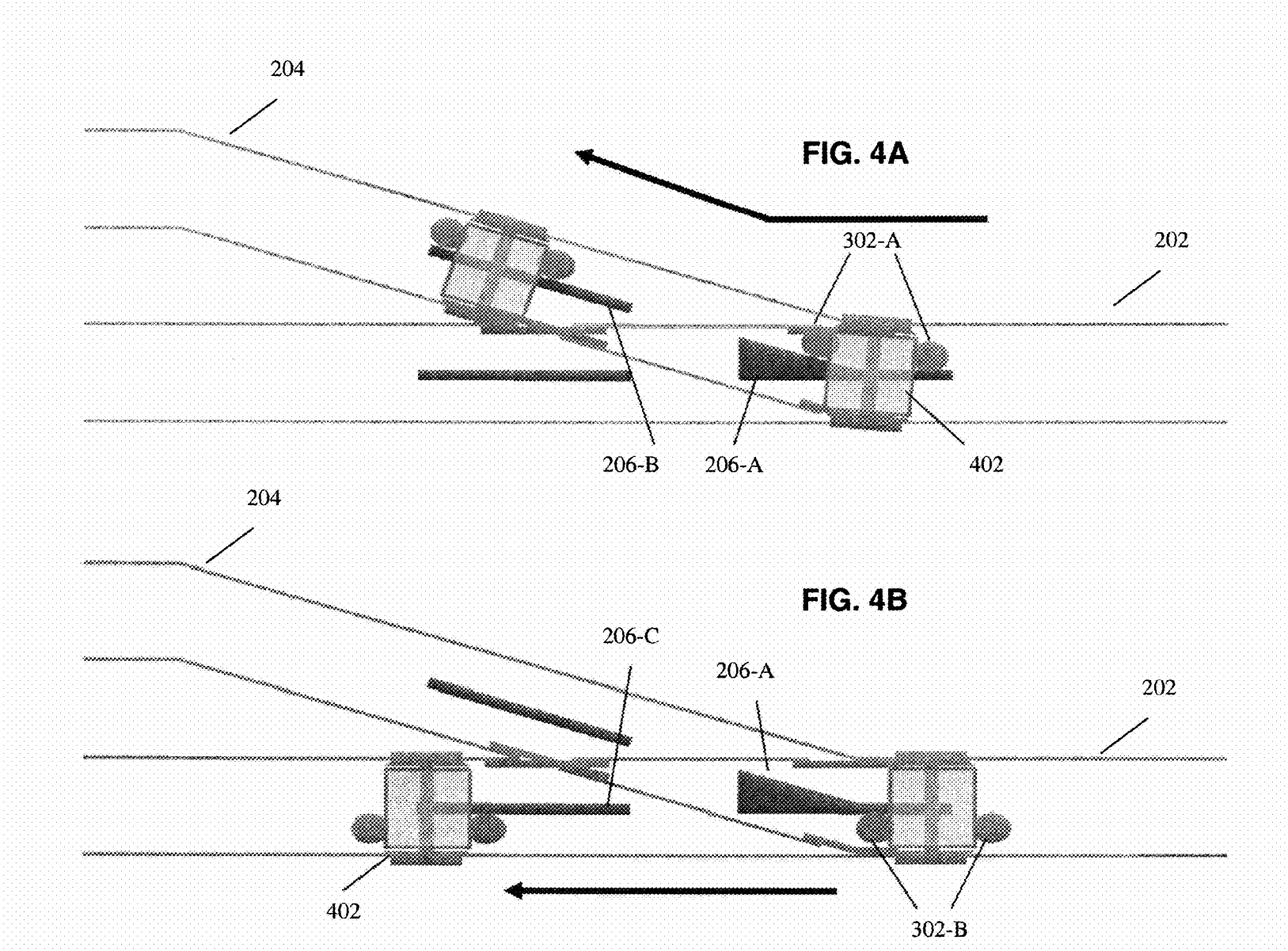
FIGS. 4A and 4B further illustrate example operational aspects of vehicle-based mechanisms and track structures such as those shown in FIGS. 2 and 3.

FIGS. 4A and 4B illustrate operational aspects of the switching mechanisms of embodiments of the invention in additional detail. In FIGS. 4A and 4B, vehicle 402 is comprised of a front and rear truck, which can be identical in nature, as depicted in the figures. A single directional vehicle would need switch wheels only on the leading side of each truck. However, these figures depict a bidirectional vehicle which has wheels on both front and back of each truck. When traversing a switch, only the leading switch wheel of each truck would need to be engaged with the switch rail, but the trailing switch wheel on each truck can safely be lowered as well, as depicted in FIGS. 4A and 4B. In FIG. 4A, vehicle 402 is switching from track 202 to track 204 (e.g. while moving right to left in the orientation of FIG. 4A). To facilitate this switching, switch wheels 302-A on the right side of vehicle 402 are controllably caused to engage with switch rails 206-A and 206-B while traversing the intersection between tracks 202 and 204.

In FIG. 4B, vehicle 402 is proceeding along track 202 and not switching onto track 204 (e.g. while moving right to left in the orientation of FIG. 4A). To facilitate this movement, switch wheels 302-B on the left side of vehicle 402 are controllably caused to engage with switch rails 206-A and 206-C while traversing the intersection between tracks 202 and 204.

Figure 5:
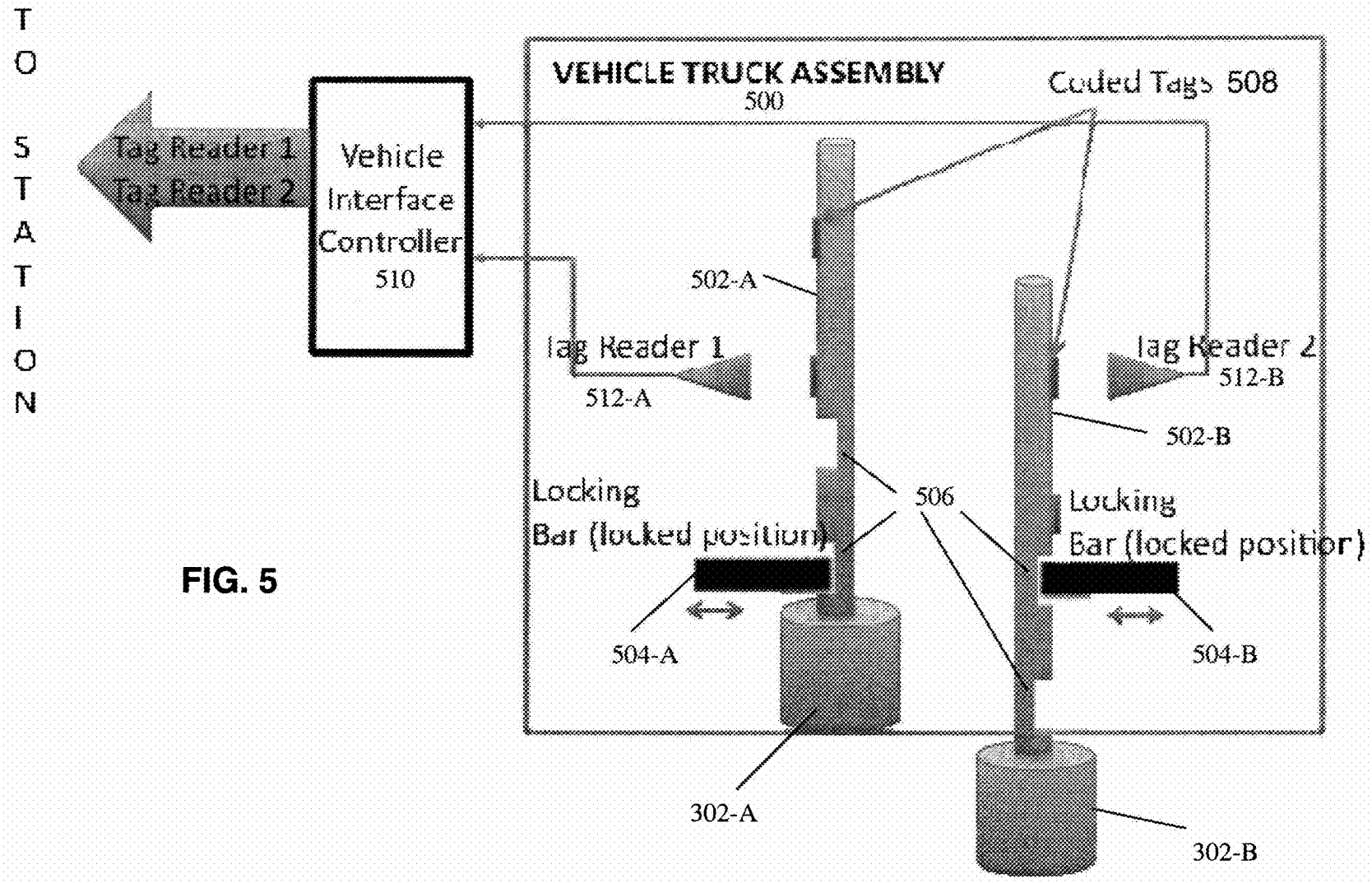
FIG. 5 is a block diagram of an example vehicle-based switch assembly according to embodiments of the invention.

FIG. 5 illustrates an example vehicle based switch mechanism 500 according to embodiments of the invention. As shown in FIG. 5, mechanism 500 includes at least one opposing pair of switch wheels 302-A and 302-B, which are respectively operated by shafts 502-A and 502-B and corresponding actuating mechanisms (not shown). Shafts 502 include locking slots 506 which controllably engage with locking mechanisms 504. FIG. 5 illustrates an example operational situation when a vehicle including mechanism 500 is traversing an intersection between tracks. In this example situation, switch wheel 302-B is being controlled to engage with a switch track (not shown) while switch wheel 302-A is being controlled to not engage with the switch track. Correspondingly, shaft 502-B has been controlled so that its upper slot 506 engages with locking mechanism 504-B, while shaft 502-A has been controlled so that its lower slot 506 engages with locking mechanism 504-A In embodiments, the shafts and locking bars can be implemented with any combination of solenoids, servo motors, or other mechanical devices that can provide motion along a single axis. Absence of an active command should force the locked position, so a spring or gravity loaded implementation is desired. Further implementation details and alternatives will become apparent to those skilled in the art after being taught by the present disclosure, so details thereof will be omitted for sake of clarity of the invention.

The present inventors further recognize that in order to operate safely using a vehicle based switching mechanism such as assembly 500, there are two criteria that are preferably met in the implementation of the control function:

1. The vehicle should not be able to report an incorrect switch position to the control logic and have the incorrect report not be detected.

2. The position of the vehicle borne switching mechanism (e.g. the positions of shafts 502-A and 502-B) should not be allowed to move once the vehicle is within the worst case stopping distance of a point of switch.

Failure to observe either criteria is independently unsafe and therefore these criteria should be met with a reliability that exceeds the system safety criteria for the system defined in terms of a Mean Time Between Hazard.

For satisfying criteria 1, one example method according to embodiments of the invention is illustrated conceptually in FIG. 5. This example method uses a sensor 512 associated with each vehicle guide wheel 302 that is capable of reading coded tags 508 that are placed in close proximity to the sensor and reporting the decoded information to a processor 510 on the vehicle to be used for the purpose of control. The tags 508 are placed on the guide wheel support mechanisms (e.g. shafts 502) such that the tag 508 representing the UP position can only be read by the sensor 512 when the switch (e.g. shaft 502) is in the up position and the tag 508 representing the DOWN position can only be read by the sensor 512 when the switch (e.g. shaft 502) is in the down position. In embodiments, the code on the tag 508 is of sufficient length and complexity and includes Cyclic Redundancy Check (CRC) error detection bits such that read errors can be detected to a level of reliability such that the probability of an UP position tag being mis-interpreted as a DOWN position tag or vice versa is sufficiently low as to support the MTBH criteria for the system. The decoded data from the tag is then communicated to the controlling processor 510, whether on the vehicle or in the station, where the data can be checked for errors, and if determined to be correct, can be used to ascertain the position of each switch guidewheel 302. The position of the shaft 502-A is verified with tag data only at a time when the Safe-To-Switch signal has been removed. If at this point an error is detected, the Safe-To-Proceed signal will be removed from the vehicle command. This is because, as described in more detail below, the Safe-To-Switch signal is only removed when the vehicle is within one worst case stopping distance of a switch.

With the method described above, there is no simple failure mechanism for the tag 508 on the switch mechanism (e.g. shaft 502) or the sensor 512 reading the tag 508 that can result in an unsafe determination of the switch position. This is because the complexity and effectiveness of the error detection code can be designed to make it extremely unlikely that data errors will go undetected and stochastically proven to support the safety design criteria. Since the data on the tag 508 is transmitted intact to a controller 510 where the information is processed and because the controller 510 using this information will be implemented to be have a MTBH in excess of $10^9$ hours, the tag 508 and the tag reading sensor 512 do not have to be implemented with any special consideration for safety.

In embodiments, the tags and sensors can be RF tags and readers, or bar codes and readers, or other similar technologies that allow a sufficient amount of detail to be encrypted onto a small tag and then reliably read by a reader that is in the immediate vicinity.

In embodiments, controller 510 can be implemented by vehicle-borne and/or station-borne components such as those described in co-pending application Ser. No. 13/218,423. Those skilled in the art will be able to understand how to adapt such controller components for use with the present invention after being taught by the present specification.

Figure 6:
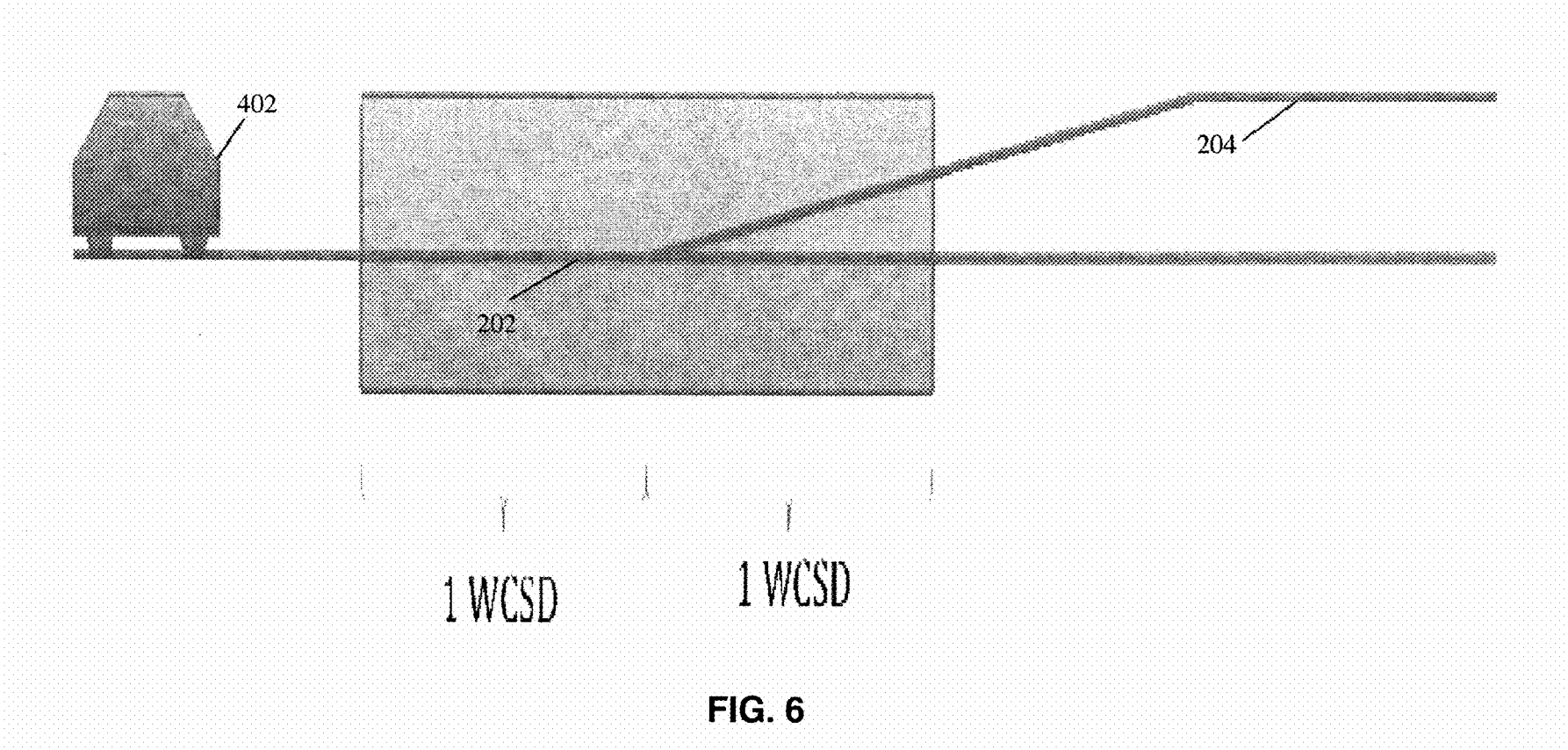
FIG. 6 further illustrates aspects of fail-safe operation of vehicle-based switches according to embodiments of the invention.

For compliance with criteria 2, one example method shown in FIG. 6 uses vital location sensing of the vehicle at all times. Any time the vehicle is detected to be within one Worst Case Stopping Distance (WCSD) of a switch rail 206, then the Safe-To-Switch signal will be removed from the vehicle command. When the Safe-To-Switch signal is not present, then all switch locking bars 504 on that vehicle must be in the locked position, and the tag readers 512 must detect the tags 508 that correspond to the safe direction of travel. If any of the locking bars 504 are not locked or the correct tags 508 are not detected (the wrong tag is detected, no tag is detected, or there is an error in tag reading), and the Safe-To-Switch signal is not present, the Safe-To-Proceed signal will be removed from the vehicle command. The WCSD will be calculated using the civil speed limit on the track near the switch. In order to achieve smooth operation of the system, the vehicle switches must be moved to safe positions in advance of reaching one WCSD from the next switch.

In embodiments, no additional hardware is required. Because the control system must track the location of each vehicle vitally in order to maintain vehicle-to-vehicle headways, this same tracking ability can be used to determine whether a vehicle can safely move a switch.

Although the present invention has been particularly described with reference to the preferred embodiments thereof, it should be readily apparent to those of ordinary skill in the art that changes and modifications in the form and details may be made without departing from the spirit and scope of the invention. It is intended that the appended claims encompass such changes and modifications.

What is claimed is:

1. An apparatus for causing a vehicle to switch tracks in a fixed guideway transportation system, the apparatus comprising:

a switch mechanism mounted on the vehicle that interoperates with corresponding fixed track structures to allow the vehicle to switch tracks without any moving components on the tracks, wherein the switch mechanism includes:

a switch wheel that is adapted to engage with certain of the corresponding fixed track structures;

a shaft connected to the switch wheel that controllably moves the switch wheel between a first position that prevents engagement with the certain fixed track structures and a second position that allows engagement with the certain fixed track structures, wherein the shaft comprises corresponding first and second locking slots for the first and second positions, and a locking bar that controllably engages with the first and second locking slots to lock the shaft in the first and second positions, respectively;

first and second coded tags on the shaft corresponding to the first and second positions; and a tag reader adapted to sense the first and second tags, wherein the tag reader is fixedly positioned adjacent to the shaft such that it can only sense the first and second tags when the shaft is in the first and second positions, respectively, and wherein the tag reader sends a first signal when the shaft is in the first position, and sends a second signal when the shaft is in the second position.

2. The apparatus according to claim 1, wherein the first and second tags have respective different codes.

3. The apparatus according to claim 1, further comprising:

an interface coupled to the tag reader that communicates the first and second signals to a control system.

4. The apparatus according to claim 1, wherein the switch wheel is a first one of a pair of switch wheels, and wherein the switch mechanism further includes:

a second one of the switch wheels that is also adapted to engage with certain of the corresponding fixed track structures; and a second shaft connected to the second one of the switch wheels that controllably moves the second one of the switch wheels between a first position that prevents engagement with the certain fixed track structures and a second position that allows engagement with the certain fixed track structures, wherein when the first one of the switch wheels is in the first position and the second one of the switch wheels is in the second position, the vehicle is forced to travel in a first direction through a switch point in the tracks, and wherein when the first one of the switch wheels is in the second position and the second one of the switch wheels is in the first position, the vehicle is forced to travel in a second different direction through the switch point.

5. A method for causing a vehicle to switch tracks in a fixed guideway transportation system, the method comprising:

mounting a switch mechanism on the vehicle; and causing the switch mechanism to interoperate with corresponding fixed track structures to allow the vehicle to switch tracks without any moving components on the tracks, wherein the switch mechanism includes:

a switch wheel that is adapted to engage with certain of the corresponding fixed track structures; and a shaft connected to the switch wheel that controllably moves the switch wheel between a first position that prevents engagement with the certain fixed track structures and a second position that allows engagement with the certain fixed track structures, wherein the causing step includes causing the switch wheel to move to one of the first and second positions, and wherein the shaft comprises corresponding first and second locking slots for the first and second positions, and a locking bar that controllably engages with the first and second locking slots, and wherein the causing step further includes causing the locking bar to engage with one of the first and second locking slots, wherein the switch mechanism further comprises:

first and second coded tags on the shaft corresponding to the first and second positions; and a tag reader adapted to sense the first and second tags, the method further comprising:

fixedly positioning the tag reader adjacent to the shaft such that it can only sense the first and second tags when the shaft is in the first and second positions, respectively;

sending a first signal from the tag reader when the shaft is in the first position; and sending a second signal from the tag reader when the shaft is in the second position.

6. The method according to claim 5, wherein the first and second tags have respective different codes.

7. The method according to claim 5, further comprising:

communicating the first and second signals to a control system.

8. The method according to claim 5, wherein the switch wheel is a first one of a pair of switch wheels, and wherein the switch mechanism further includes:

a second one of the pair of switch wheels that is also adapted to engage with certain of the corresponding fixed track structures; and a second shaft connected to the second one of the switch wheels that controllably move both of the switch wheels between a first position that prevents engagement with the certain fixed track structures and a second position that allows engagement with the certain fixed track structures, wherein the causing step includes:

causing the first one of the switch wheels to be in the first position and the second one of the switch wheels to be in the second position when the vehicle is to travel in a first direction through a switch point in the tracks; and causing the first one of the switch wheels to be in the second position and the second one of the switch wheels to be in the first position when the vehicle is to travel in a second different direction through the switch point.

9. A fixed guideway transportation system comprising:

a switch point between a first set of rails and a second set of rails;

fixed track structures at the switch point; and a switch mechanism mounted on a vehicle that interoperates with certain of the fixed track structures to allow the vehicle to switch between the first set of rails and second set of rails without any moving components on the rails, wherein the switch mechanism includes:

a switch wheel that is adapted to engage with the certain fixed track structures; and a shaft connected to the switch wheel that controllably moves the switch wheel between a first position that prevents engagement with the certain fixed track structures and a second position that allows engagement with the certain fixed track structures, and wherein the fixed track structures include:

a set of switch rails fixed between one of the first and second sets of rails; and a set of flange rails that replaces a section of the one first and second set of rails adjacent to the switch rails, wherein the switch wheel is adapted to interoperate with the switch rails, and wherein a wheel of the vehicle rolls on the flange rails when the vehicle is being caused to switch between the first and second set of rails.

10. The system according to claim 9, wherein the shaft comprises corresponding first and second locking slots for the first and second positions, and a locking bar that controllably engages with the first and second locking slots.

11. The system according to claim 9, further comprising:

first and second coded tags on the shaft corresponding to the first and second positions; and a tag reader adapted to sense the first and second tags, wherein the tag reader is fixedly positioned adjacent to the shaft such that it can only sense the first and second tags when the shaft is in the first and second positions, respectively, and wherein the tag reader sends a first signal when the shaft is in the first position, and sends a second signal when the shaft is in the second position.

12. The system according to claim 11, further comprising:

a control system that issues commands to controllably operate the switch mechanism; and an interface coupled to the tag reader that communicates the first and second signals to the control system.

* * * * *